US008967745B2

(12) United States Patent
Booth

(10) Patent No.: US 8,967,745 B2
(45) Date of Patent: Mar. 3, 2015

(54) MOUNTING SYSTEM FOR A BANK OF STORAGE UNITS AND THE COMBINATION OF A BANK OF STORAGE UNITS CONNECTED TO THE MOUNTING SYSTEM

(75) Inventor: Kevin Everett Booth, Mapleton, UT (US)

(73) Assignee: Penco Products, Inc., Skippack, PA (US)

( * ) Notice: Subject to any disclaimer, the term of this patent is extended or adjusted under 35 U.S.C. 154(b) by 311 days.

(21) Appl. No.: 13/220,145

(22) Filed: Aug. 29, 2011

(65) Prior Publication Data

US 2013/0049561 A1 Feb. 28, 2013

(51) Int. Cl.
*A47B 91/00* (2006.01)

(52) U.S. Cl.
USPC ..... 312/351.2; 312/198; 248/152

(58) Field of Classification Search
USPC ..... 312/257.1, 107, 108, 111, 351.1, 351.2, 312/198–202; 52/293.3, 126.3; 248/146, 248/152, 346.01, 188.1, 188.2, 551, 637, 248/639, 676, 678–680; 211/70.1, 71.01, 211/72, 74, 85.18
See application file for complete search history.

(56) References Cited

U.S. PATENT DOCUMENTS

| | | | | |
|---|---|---|---|---|
| 2,651,559 | A | 9/1953 | O'Connor | |
| 3,190,041 | A * | 6/1965 | Kimball | 248/679 |
| 3,398,491 | A * | 8/1968 | Babcock | 52/90.1 |
| 4,014,056 | A * | 3/1977 | Wainwright | 114/364 |
| 4,143,927 | A * | 3/1979 | Spear et al. | 312/237 |
| 4,249,684 | A * | 2/1981 | Miller et al. | 224/42.4 |
| 4,289,363 | A * | 9/1981 | Andersson et al. | 312/257.1 |
| 4,317,416 | A | 3/1982 | Baum et al. | |
| 4,731,915 | A * | 3/1988 | Holder | 29/402.03 |
| 4,783,034 | A | 11/1988 | Ostrander et al. | |
| 5,016,338 | A * | 5/1991 | Rowan, Jr. | 29/423 |
| 5,417,021 | A * | 5/1995 | Tavshanjian | 52/243.1 |
| 5,713,550 | A * | 2/1998 | Schwarzli | 248/346.02 |
| 6,027,190 | A * | 2/2000 | Stewart et al. | 312/201 |
| 6,082,272 | A * | 7/2000 | Adrain | 109/51 |
| 6,231,138 | B1 * | 5/2001 | Janson | 312/201 |

(Continued)

*Primary Examiner* — Darnell Jayne
*Assistant Examiner* — Ryan A Doyle
(74) *Attorney, Agent, or Firm* — Caesar, Rivise, Bernstein, Cohen & Pokotilow, Ltd.

(57) ABSTRACT

A mounting system for mounting a bank of storage units in side-by-side relationship above a ground surface includes an elongate member having an elongate top wall, having side edges and at least one leg section extending downwardly from one of the side edges. Each of the at least one leg section includes an elongate flange at a distal end that is contiguous to the ground. The elongate top wall has an elongate dimension between opposed ends for receiving a bank of storage units in side-by-side relationship on an upper surface thereof. The top wall includes attachment members for cooperating with a mounting plate for attaching the bank of storage units in side-by-side relationship to the top wall. The elongate flanges include a plurality of leveling adjuster passages for receiving leveling adjusters therethrough and a plurality of anchor passages for receiving anchoring members therethrough. The plurality of adjuster passages on each flange includes leveling adjuster passages located adjacent each elongate end of the flanges for receiving leveling adjuster members therethrough to engage a ground surface and provide a leveling function. A plurality of anchor passages is adapted to receive anchoring members insertable into the ground surface for securing the elongate member to the ground surface. The invention also resides in the combination of the mounting system and a bank of lockers attached to it, as well as to storage units including a mounting plate as part of its construction.

13 Claims, 11 Drawing Sheets

(56) References Cited

U.S. PATENT DOCUMENTS

| | | | | |
|---|---|---|---|---|
| 6,256,960 | B1 * | 7/2001 | Babcock et al. | 52/592.1 |
| 6,408,583 | B1 * | 6/2002 | Hertweck | 52/334 |
| 6,663,061 | B1 * | 12/2003 | Morris | 248/188.2 |
| 7,524,002 | B2 | 4/2009 | Punzel et al. | |
| 7,828,399 | B1 | 11/2010 | Bass | |
| 8,020,416 | B2 * | 9/2011 | Talmage et al. | 70/85 |
| 2003/0196112 | A1 * | 10/2003 | Beuchat et al. | 713/200 |
| 2004/0060918 | A1 * | 4/2004 | Woodlief et al. | 219/421 |
| 2004/0211872 | A1 * | 10/2004 | Dittmer et al. | 248/323 |
| 2008/0042534 | A1 * | 2/2008 | Mallouk | 312/309 |
| 2010/0050706 | A1 * | 3/2010 | O'Neill | 70/58 |
| 2010/0176256 | A1 * | 7/2010 | Bove | 248/188.4 |
| 2011/0115351 | A1 * | 5/2011 | McManic et al. | 312/270.1 |
| 2012/0228466 | A1 * | 9/2012 | Haidvogl | 248/679 |

* cited by examiner

MOUNTING SYSTEM FOR A BANK OF STORAGE UNITS AND THE COMBINATION OF A BANK OF STORAGE UNITS CONNECTED TO THE MOUNTING SYSTEM

BACKGROUND OF THE INVENTION

1. Field of Invention

This invention relates generally to a mounting system for storage units, such as lockers, cabinets and similar structures, and more particularly to a mounting system for mounting a bank of storage units above a ground surface and in a level, side-by-side arrangement. In addition, this invention relates to the combination of a bank of storage units connected to a mounting system and also to a storage unit employing a locking plate for attachment to a support surface.

2. Background Art

Storage units, such as lockers or cabinets used for personal storage are required to sit on a supporting mounting plate. This may be the floor or other ground surface of a facility in which the storage units are contained. Frequently, the storage units are mounted on concrete slabs or abutments forming part of the floor structure or separately placed or formed on the floor structure.

Stand alone lockers typically are provided with a fixed pair of front legs and a pair of adjustable back legs to permit leveling of the individual lockers.

However, when storage units, such as lockers, are intended for permanent or "built in" applications they generally are provided without legs and are mounted or secured to a raised base, such as a concrete abutment. In these latter installations it is critical for the storage units to be level and plumb. When storage units are not level or plumb there may be gaps and other misalignments between the storage units in the bank. Moreover, when the storage units are not level door function is compromised in that, at the very least, adjustments need to be made to the locking mechanisms of the doors to get them to work properly.

Unfortunately, concrete bases poured using normal construction techniques and following commonly accepted standards typically fail to meet the ideal requirement for mounting storage units, such as lockers. In the best of cases, installers need to use shims to achieve a level and plumb condition among the lockers in the bank. This can be a very time consuming and costly process and, in fact, often is not done well or not done at all.

U.S. Pat. No. 4,289,363 (Andersson et al.) discloses a locker construction in multiple different arrangements. This patent discloses a locker support comprising stands 23 held together by square section pipes 24. The Andersson '363 patent does not disclose any arrangement for leveling a support and permanently affixing it to a floor or other ground surface. Moreover, the Andersson '363 patent does not disclose any mounting system employing cooperating members for connecting a bank of storage units to the upper wall of any mounting structure.

U.S. Pat. No. 4,317,416 (Baum et al.) discloses a connecting mechanism for a desk top employing teardrop-shaped openings for cooperating with the heads of bolts secured into a base member. There is no disclosure that this type of locking arrangement could possibly be adapted to interconnect storage units, such as lockers and cabinets, to any supporting surface.

U.S. Pat. No. 4,783,034 (Ostrander et al.) discloses a slide-lock mechanism associated with a shaped base plate assembly for permitting additional articles, such a transformer 16 to be removably attached thereto. Again, this patent does not remotely suggest that the slide-lock mechanism disclosed therein, or anything similar to that, could possibly be employed to connect a storage unit, such as a locker or cabinet, to any mounting structure.

U.S. Pat. No. 7,524,002 (Punzel et al.) discloses a plurality of lockers including self leveling features in the bases thereof (FIG. 9). However, this patent does not disclose a mounting system for a bank of storage units, wherein the mounting system itself is provided with leveling capability, support capability and locking capability.

U.S. Pat. No. 7,828,399 (Bass) discloses a locker system wherein individual lockers have adjustable legs (FIG. 11). This is a common type of system for use in leveling individual lockers, and does not relate in any way to providing a level support for a bank of lockers in accordance with the present invention.

BRIEF SUMMARY OF THE INVENTION

A mounting system in accordance with this invention mounts a bank of storage units in a side-by-side relationship above a ground surface and each storage unit in the bank includes a mounting plate for attachment to the mounting system. The mounting system in accordance with this invention includes an elongate member including a top wall having an elongate dimension between opposed ends and a transverse dimension between opposed, elongate side edges. At least one leg section extends downwardly from a side edge and terminates in an elongate flange contiguous to the ground. The top wall is adapted to receive a bank of storage units in a side-by-side relationship on an upper surface of the top wall, and each of the elongate flanges includes an elongate dimension between opposed end edges thereof. The elongate top wall includes attachment members for cooperating with the mounting plate of each of the storage units for attaching the bank of storage units in a side-by-side relationship to the top wall. In addition, each of the elongate flanges includes a plurality of leveling adjuster passages for receiving leveling adjusters therethrough and a plurality of anchor passages for receiving anchoring members therethrough. The plurality of leveling adjuster passages and plurality of anchor passages are spaced along the elongate dimension of the elongate flanges. The plurality of leveling adjuster passages in each flange include leveling adjuster passages located adjacent each elongate end of the flanges for receiving leveling adjuster members therethrough for engaging the ground surface to assist in leveling of the top wall. The plurality of anchor passages is adapted to receive anchoring members that are insertable into the ground surface for securing the elongate member to the ground surface.

In a preferred embodiment of this invention a leg section extends downwardly from each side edge of the top wall of the elongate member; each leg section terminating in a flange including leveling adjuster passages located adjacent each elongate end thereof for receiving leveling adjuster members therethrough for engaging the ground surface to assist in leveling the top wall substantially from end-to-end and substantially from side edge-to-side edge.

In a preferred embodiment of this invention the elongate flanges extend inwardly, in underlying relationship to the top wall, and the top wall includes a plurality of leveling adjuster access passages and a plurality of anchor access passages aligned with a plurality of leveling adjuster passages and anchor passages in the underlying flanges, respectively. This permits actuation of the level adjuster members and the anchoring members through the top wall of the elongate member.

Preferably the mounting system is an elongate member that is a unitary, extruded metal member, preferably formed of aluminum. This provides a non-corrosive structure to minimize or actually eliminate corrosion of the lockers mounted thereon, due to undesirable ground conditions.

In the most preferred embodiment of this invention the storage units are lockers or cabinets having a rigid door jamb providing an opening into the unit and adapted to receive a moveable door for opening and closing the opening into the storage unit. In these preferred constructions the storage unit includes peripheral side walls, a peripheral back wall, a bottom wall and a top wall.

An additional aspect of this invention resides in the combination of a mounting system and a bank of storage units connected thereto. In this combination the mounting system mounts a bank of storage units in side-by-side relationship above a ground surface and the bank of storage units is attached to it. The mounting system includes an elongate member having a top wall that has an elongate dimension terminating at opposed ends and a transverse dimension terminating at opposed side edges. In addition, at least one leg section extends downwardly from at least one of the opposed elongate side edges, each of said at least one leg sections including a proximal end terminating at a respective side edge of said top wall and a distal end terminating in an elongate flange, said flange including a plurality of leveling adjuster passages and a plurality of anchor passages therethrough. In this combination leveling adjuster members extend through the leveling adjuster passages and engage the ground surface for assisting in substantially leveling the top wall. A plurality of anchoring members extends through the anchor passages and into the ground surface for securing the elongate member to the ground surface In this combination the storage units in the bank each include a mounting plate and the top wall of the elongate member includes attachment members that are also connected to the mounting plate of each of the storage units for attaching each of the storage units in the bank to the top wall of the mounting system in a side-by-side condition.

In the preferred combination a pair of leg sections extends downwardly from the elongate side edges of the top wall and each of said leg sections includes a flange adjacent the ground. Each of the flanges includes a plurality of leveling adjuster passages for receiving leveling adjuster members to assist in leveling the top wall from end-to-end and from-side to-side.

In the preferred combination the plate includes a mounting wall with peripheral edges that provide openings therein. The peripheral edges of each opening provide a narrow opening segment in communication with an enlarged opening segment. The attachment members connected to the top wall of the mounting system include shoulders spaced from an upper surface of the top wall and extending through openings in the mounting walls of the storage unit. In the connected position the shoulders overlay surfaces of the mounting wall adjacent narrow segments of the opening to thereby prevent the storage units from being lifted off the mounting system.

An additional aspect of this invention resides in a storage unit including peripheral side walls, a peripheral rear wall and a bottom wall. The bottom wall is spaced above lower edges of the storage unit to provide a lower, recessed region under the bottom wall. A mounting plate is connected to the storage unit in the recessed region thereof and includes a mounting surface. The mounting surface is adapted to be received on a support surface and includes attachment means for cooperating with attachment means on the support surface to join the storage unit to the support surface.

In a preferred storage unit construction the attachment means of the mounting surface includes a plurality of substantially tear-drop shaped passages therethrough. Each passage has a narrow segment and an enlarged segment communicating with the narrow segment. The mounting plate is adapted to be received on the support surface; said attachment means on the support surface include raised shoulders dimensioned to be passed through the enlarged segment of each passage in the mounting surface and to overlie the mounting surface when slid into the narrow segment of each passage.

Other objects and advantages of this invention will become apparent by referring to the description of the drawings which follows taken in conjunction with the detailed description of preferred embodiments of the invention.

DESCRIPTION OF BEST MODES OF THE INVENTION

Definition of Terms

Reference throughout this application to "unitary" in describing the elongate member of the mounting system means that the specified metal member is a continuous member free of welds, bolts and other similar fastening devices to attach sections together. Most commonly the "unitary member" referred to herein is formed in an extrusion operation.

Reference to "storage units" means lockers, cabinets and similar structures employing an enclosed body for storing items and having an opening into the body and a door moveably attached to the body for opening and closing the opening into the body.

Reference to a "bank" of storage units means two or more of such units.

Description

Figure 1:
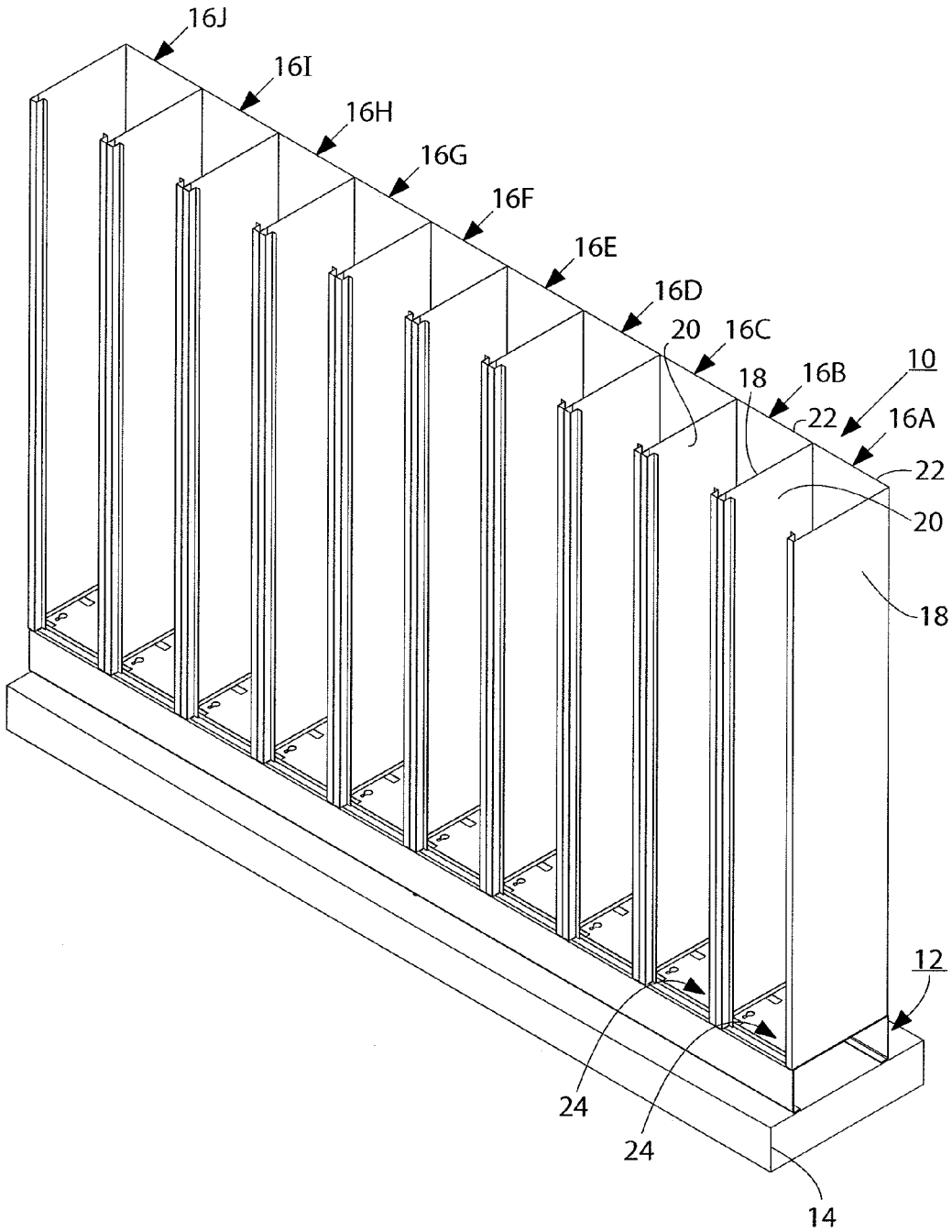
FIG. 1 is an isometric view, somewhat schematic, illustrating the mounting of a bank of storage units, in the form of lockers, on a mounting system in accordance with this invention, with parts of the storage unit omitted for purposes of clarity.

A bank of storage units 10 attached to a mounting system 12 in accordance with this invention is shown in FIG. 1. As will be discussed in detail hereinafter, the mounting system 12 is leveled and anchored to a floor or similar supporting surface 14

As illustrated in FIG. 1, the bank of storage units 10 is illustrated as including ten (10) lockers 16A-16J. Although lockers 16A-16J often will be identified as the storage units employed in this invention, the specific disclosure and discussion of lockers in this application is not intended to be a limitation on the broadest aspects of this invention in which the "storage units" can be structures other than lockers, as defined earlier in this application.

As noted earlier the bank of storage units 10 in accordance with this invention includes at least two (2) units; the number of storage units in the bank being a matter of choice, depending upon the number of units needed in the facility, the space available for mounting the units, etc.

Still referring to FIG. 1, it should be noted that for purposes of clarity only peripheral side walls 18, 20, rear wall 22 and a unique mounting plate 24 of each of the storage units, in the form of lockers, is illustrated. Specifically, in the locker constructions illustrated in FIG. 1, the top wall, bottom wall and door have not been illustrated, and can be of any common, conventional design employed in storage units, such as lockers.

In a preferred embodiment of this invention the unique mounting plate 24 can be included in a storage unit construction of the type shown in commonly-owned, pending U.S. application Ser. No. 13/187,999, filed on Jul. 21, 2011, the subject matter of which is herein incorporated by reference. However, it should be understood that any storage unit construction capable of including the unique mounting plate 24 can be employed in this invention, for purposes of permitting a bank of the storage units, e.g., 16A-16J, to be connected to the mounting system 12.

Figure 2:
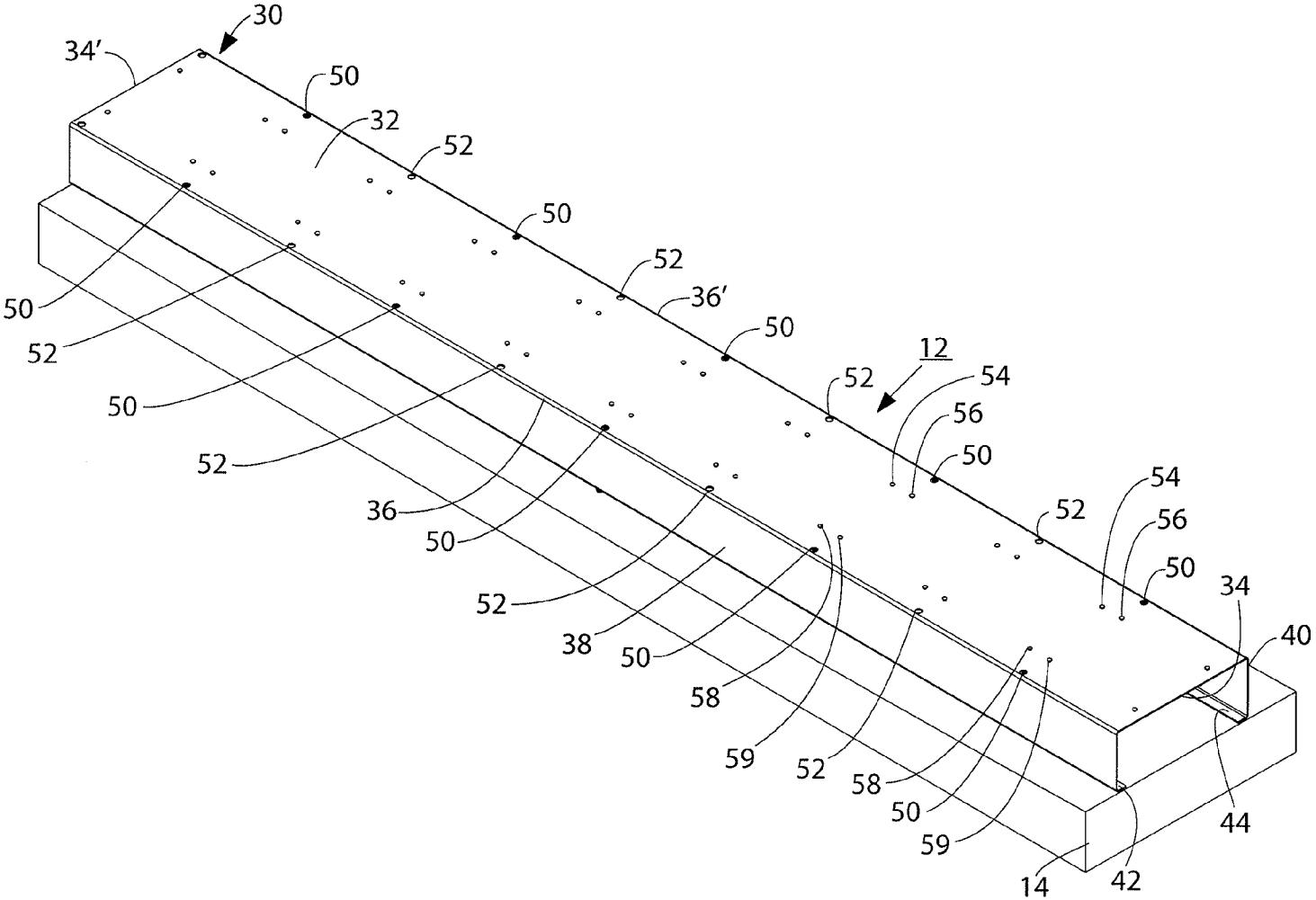
FIG. 2 is an isometric view illustrating a mounting system in accordance with this invention, positioned on a floor or other ground surface.
Figure 3:
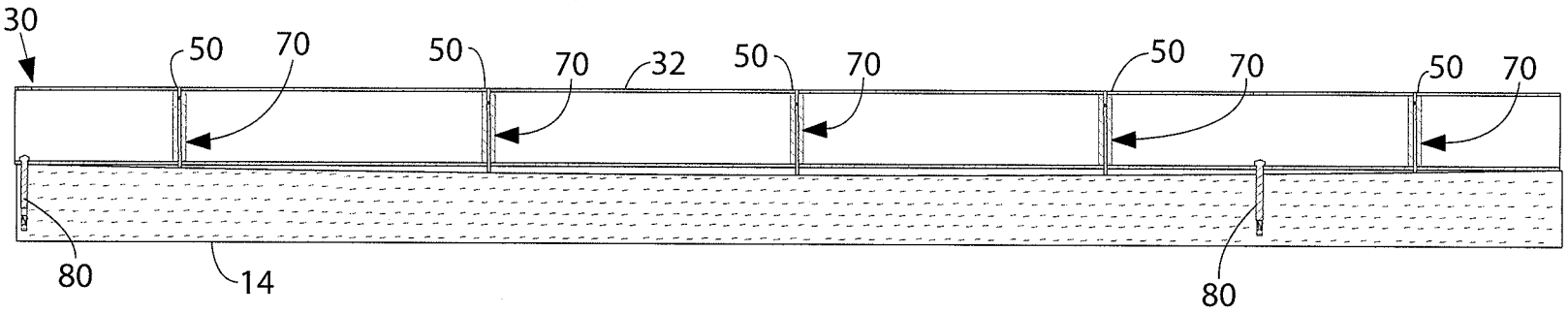
FIG. 3 is a longitudinal sectional view through the mounting system and floor shown in FIG. 2, illustrating details of the mounting and leveling of the mounting system to a floor.
Figure 4:
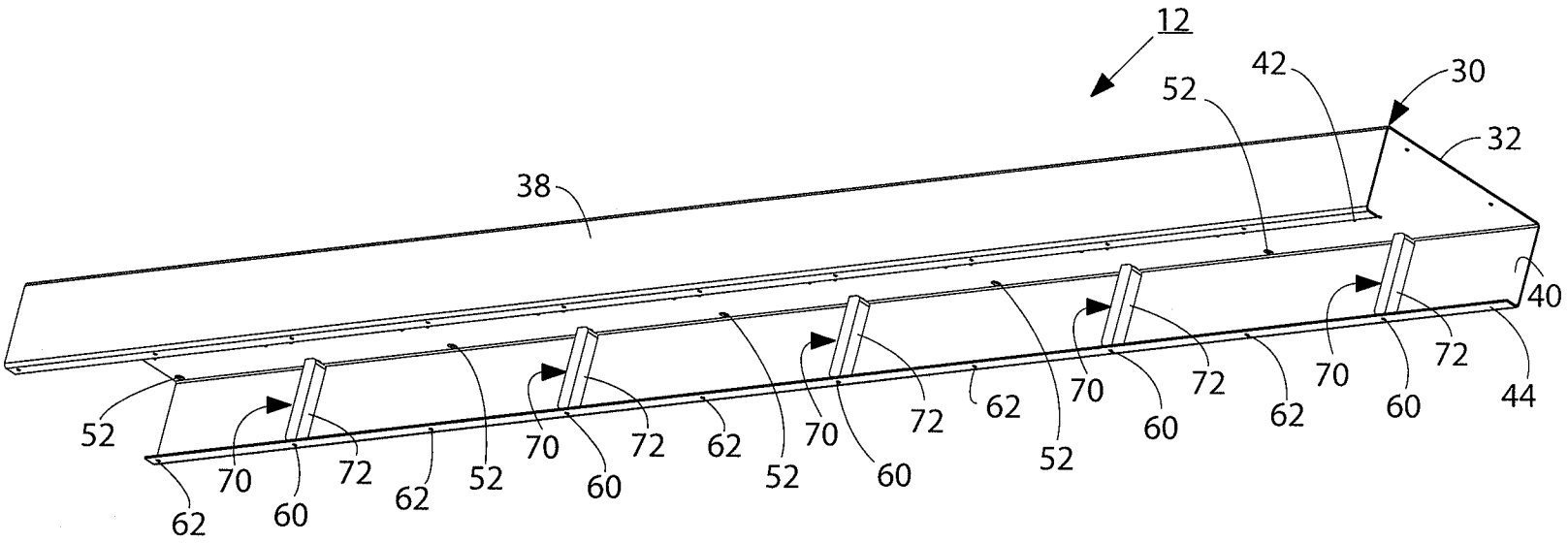
FIG. 4 is a bottom isometric view illustrating the mounting of leveling adjuster members in the mounting system of this invention.
Figure 4A:
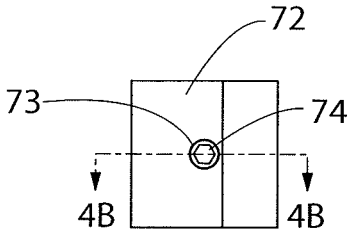
FIG. 4A is a plan view of a leveling adjuster member employed in a preferred embodiment of this invention.

Referring to FIGS. 2-4, the mounting system 12 in accordance with a preferred embodiment of this invention is an elongate member 30 employing an elongate top wall 32 having an elongate dimension between opposed ends 34, 34' and a transverse dimension between opposed side edges 36, 36'. Joined to each of the side edges of the top wall are downwardly extending leg sections 38, 40, and the leg sections terminate in elongate flanges 42, 44 that are positioned contiguous to the ground 14 to which the mounting system 12 is intended to be connected.

It should be understood that in the preferred embodiment of this invention the elongate flanges 42, 44 extend inwardly toward each other to thereby underlie the top wall 32. This enhances the strength of the mounting system 12 and also reduces the transverse dimension of the mounting system, as compared to forming the mounting system with the flanges directed outwardly.

Referring to FIG. 2, a plurality of leveling adjuster access passages 50 and a plurality of anchor access passages 52 are disposed adjacent each of the elongate side edges 36, 36' of the top wall 32. In a preferred embodiment of this invention the leveling adjuster access passages 50 and anchor access passages 52 alternate along the elongate extent of the top wall 32.

Still referring to FIG. 2, it should be noted that a plurality of sets of attachment member passages are provided in the top wall 32; each set including four (4) attachment member passages 54, 56, 58 and 59. Each of the sets of four (4) attachment member passages are employed to receive attachment members for securing an individual storage unit in a bank of such storage units to the mounting system 12, as will be described in greater detail hereinafter.

Referring to FIGS. 3 and 4, leveling adjuster passages 60 and anchor passages 62 are provided in each of the elongate flanges 42, 44; said leveling adjuster passages 60 being vertically aligned with leveling adjuster access passages 50 and the anchor passages 62 being vertically aligned with the anchor access passages 52. As will be discussed in greater detail hereinafter, the leveling adjuster access passages 50 and anchor passages 62 are sufficiently large to accommodate an adjusting or mounting tool for actuating leveling screws and anchors, respectively.

As can be seen best in FIGS. 5, 6, 7A and 7B, preferred attachment members cooperating with the attachment member passages 54, 56, 58 and 59 in the top wall 32 are shoulder rivets 64, 65, 66 and 67, each having an enlarged head 68 spaced above the top surface of the top wall 32 of elongate member 30.

Referring to FIGS. 3, 4, 4A and 4B, each of a plurality of leveling adjuster members 70 preferably includes a tapped, aluminum block 72 having a threaded passage 73 therethrough into which a leveling screw 74 is threaded for vertical movement. The upper end of the threaded leveling screw includes a recess for receiving an adjusting tool, such as an Allen wrench, to permit vertical movement of the leveling screw into engagement with the ground 14 to provide its leveling function, as will be discussed in greater detail hereinafter.

Figure 4B:
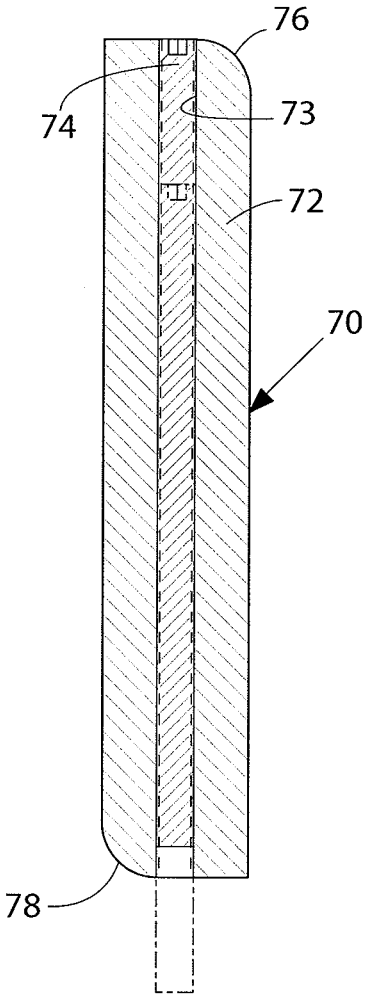
FIG. 4B is a sectional view along line 4B-4B of FIG. 4A illustrating, in solid representation the position of the leveling screw retracted in the leveling adjuster member prior to actuating the leveling screw to provide the leveling function, and showing in phantom view an extended position of the leveling screw that is assumed when the screw is employed to engage the ground as part of the leveling operation.
Figure 5:
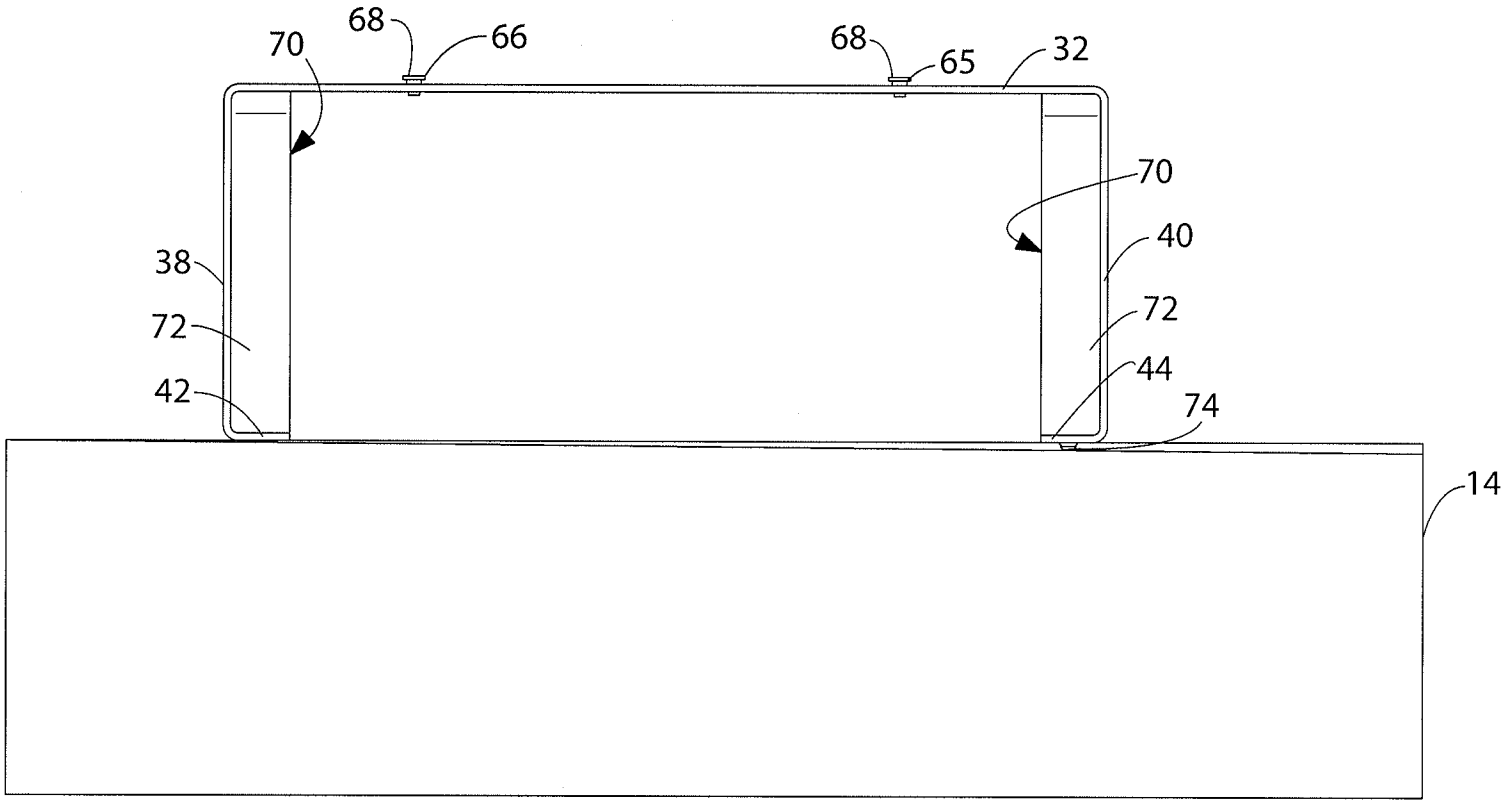
FIG. 5 is a right end elevational view of the mounting system and floor illustrated in FIG. 2, including shoulder rivets attached to the top wall of the mounting system for cooperating with openings in the bottom mounting plate of the storage units to provide a desired connection between the storage units and the mounting system.

Referring specifically to FIG. 4B, it should be noted that the tapped aluminum block 72 includes diametrically opposed curved section 76, 78 to enhance the assembly of the tapped aluminum block 72 into frictional engagement with the lower surface of top wall 32 and the upper surfaces of the underlying flanges 42, 44. Specifically, the assembly of the tapped aluminum block 72 into proper position in the mounting system 12, with the leveling screw completely refracted therein, is achieved by initially positioning the block into a generally horizontal position, moving the block into the space provided between the top wall 32 and flanges 42 and 44 into a location aligned with a leveling adjuster access passage 50 and a corresponding, vertically aligned leveling adjuster passage 60, and thereafter rotating the block 90° to provide frictional engagement between the aluminum block 72 and the lower surface of top wall 32 and upper surface of the corresponding flanges 42, 44, respectively, with the leveling screw 74 being accessible through the leveling adjuster access passage 50 to permit vertical adjustment thereof.

Figure 6:
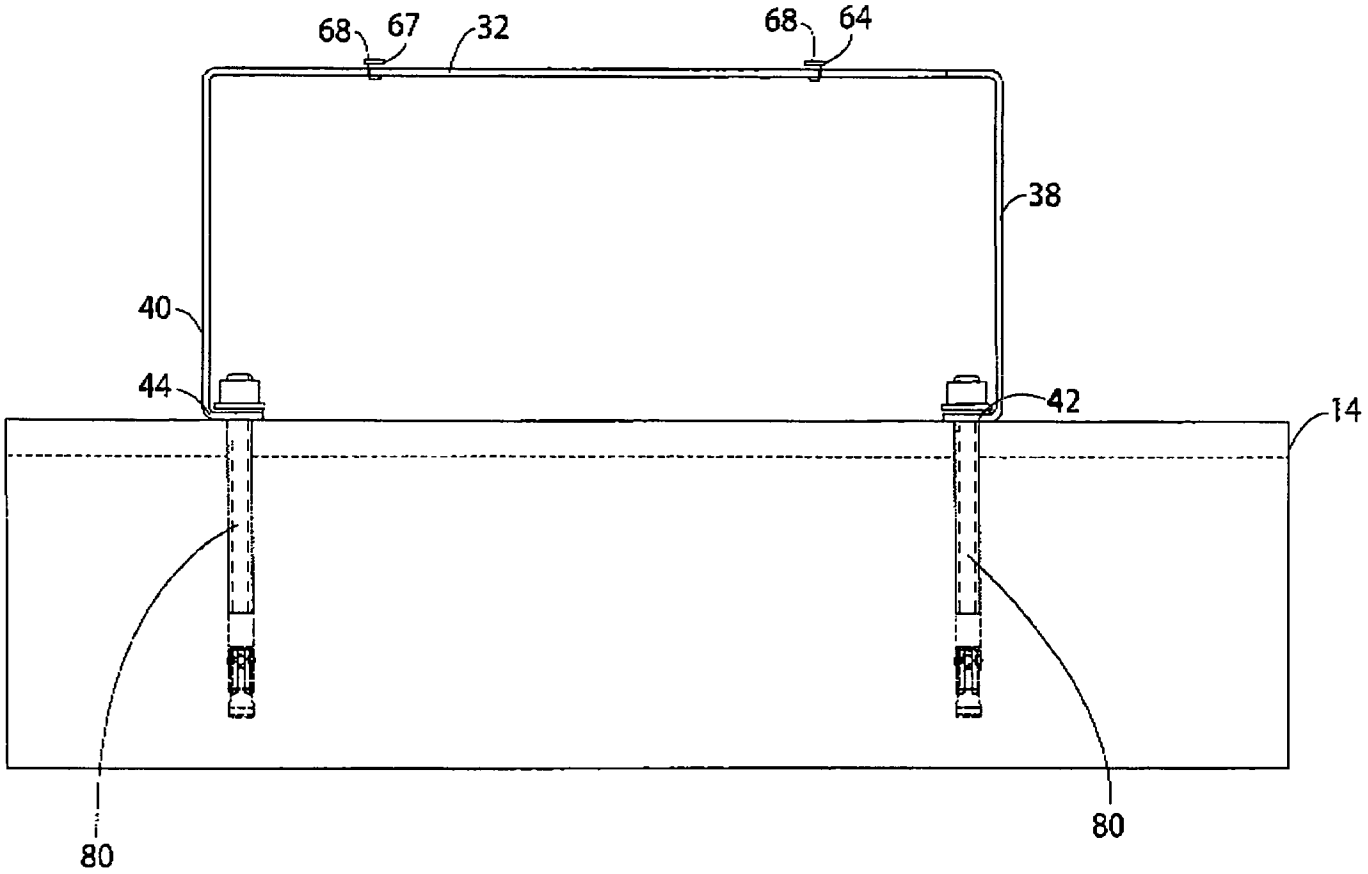
FIG. 6 is a left end elevational view of the system shown in FIG. 2, showing the cooperation of anchoring members for permanently affixing the elongate member of the mounting system to the ground.

Referring to FIGS. 3 and 6, anchoring members 80 are shown in a position attached to floor 14 to permanently attach the mounting system 12 to the floor. The manner in which the mounting system 12 is connected to the floor will be discussed in greater detail hereinafter. However, it should be noted that the particular anchoring members 80 employed in this invention will be dictated by the surface into which the anchoring member is required to be inserted. For example, if the floor is concrete then a concrete anchor will be employed. For other surfaces a lag screw may be suitable for use. The specific type of anchoring member employed in the mounting system 12 is not considered to be a limitation on the broadest aspects of this invention; any suitable anchoring member being usable in this invention.

Figure 7A:
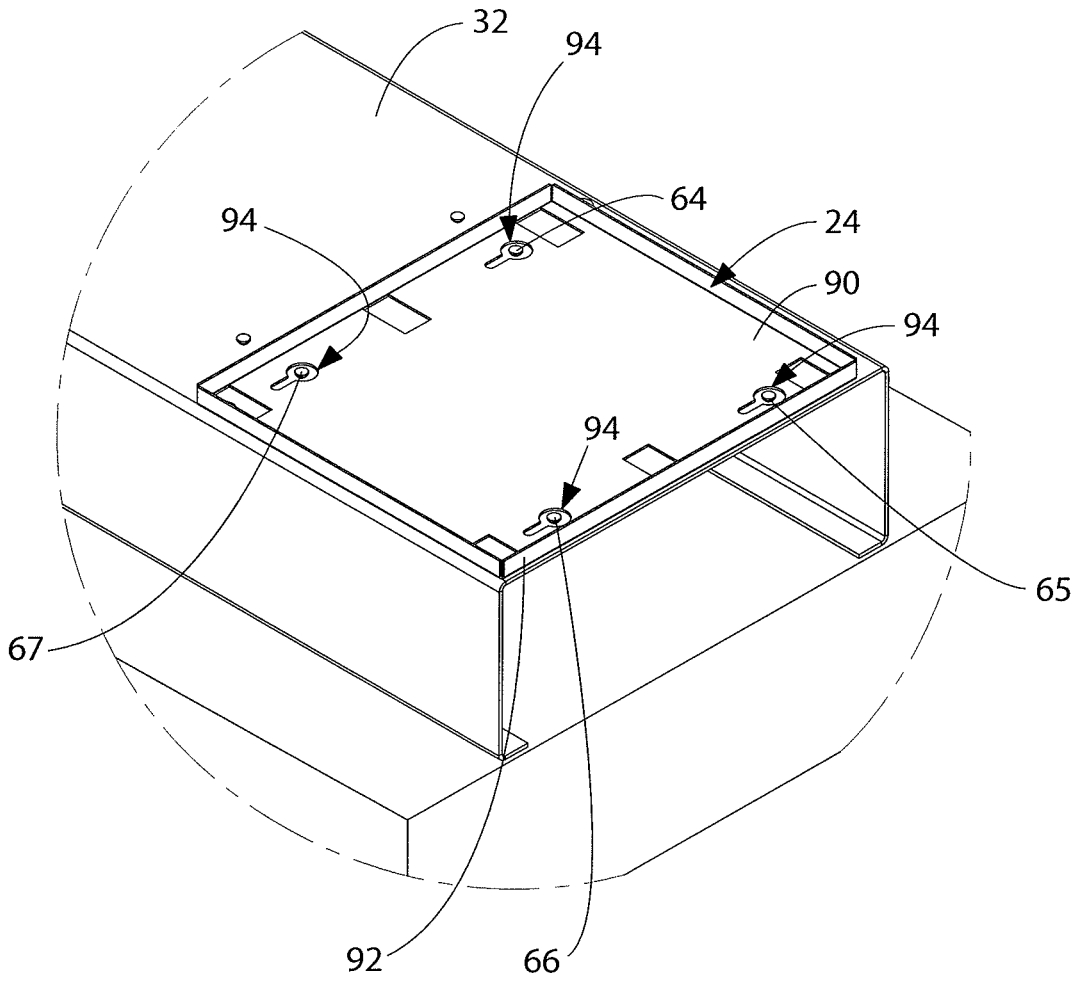
FIG. 7A shows the cooperative relationship between a mounting plate forming a permanent part of a storage unit and shoulder rivets secured to the top wall of the mounting system when the storage unit initially is placed on the mounting system, other elements of the storage unit being eliminated for purposes of clarity.
Figure 7B:
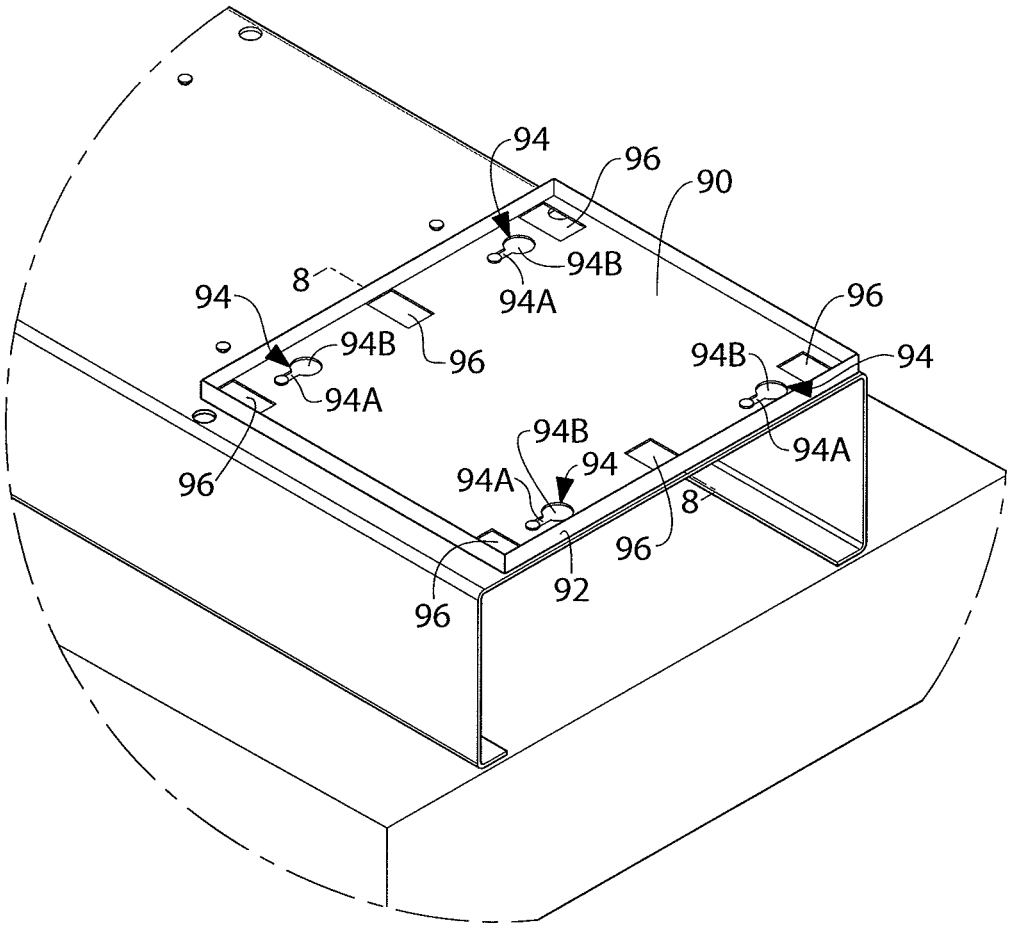
FIG. 7B is a view similar to FIG. 7A but illustrating the locked condition between the storage unit and the mounting system created by sliding the storage unit illustrated in FIG. 7A rearwardly to move the mounting plate of the storage unit rearwardly from the position shown in FIG. 7A to the position shown in FIG. 7B.

Referring to FIGS. 7A and 7B, details of construction of the mounting plate 24 of the storage units 16A-16J, are illustrated. It should be understood that the other elements of the storage unit are omitted for purposes of clarity in describing the manner in which each of the storage units is attached to the mounting system 12 in accordance with a preferred embodiment of this invention.

Still referring to FIGS. 7A and 7B, the mounting plate 24 includes a horizontal mounting wall 90 and an upstanding peripheral flange 92. Four (4) teardrop-shaped openings 94 are provided in the horizontal mounting wall 90 to cooperate with attachment members 64, 65, 66 and 67 that are in, for example, threaded, welded or riveted engagement, with the top wall 32 of the mounting system 12.

Still referring to FIGS. 7A and 7B, each of the teardrop-shaped openings 94 is provided by peripheral edges defining a narrow open segment 94A communicating with an enlarged open segment 94B. In addition, the horizontal mounting wall is provided with a plurality of welding access passages 96 to permit the spot welding of the peripheral flange 92 to contiguous inner surfaces of walls of a locker or other storage unit.

Figure 8:
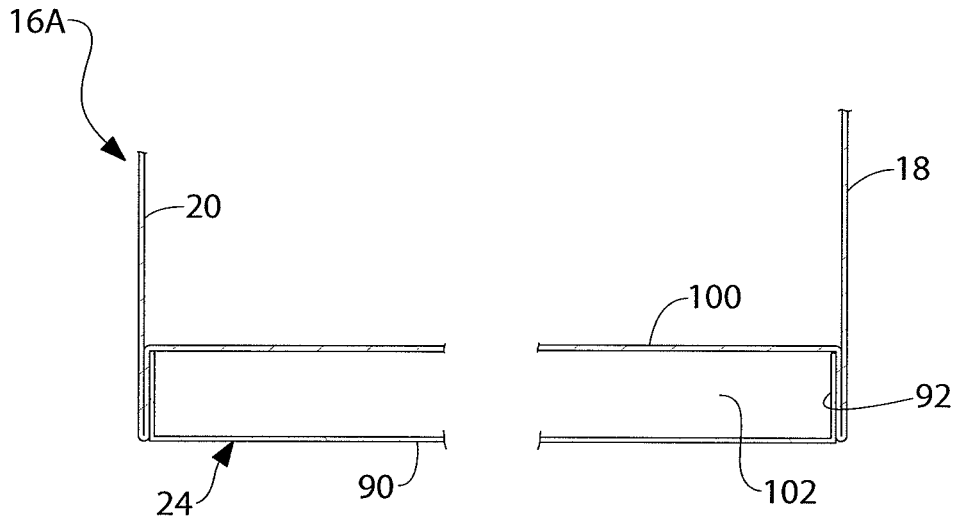
FIG. 8 is an isometric view schematically illustrating a storage unit in accordance with this invention including a mounting plate positioned within a recess in the lower end of a storage unit.

Referring to FIG. 8, a partial, schematic lower sectional view of one of the storage units, in the form of locker 16A is shown for the purpose of illustrating the manner in which the mounting plate 24 is spot welded to the locker. Specifically, the lower wall of the locker is illustrated at 100 and defines a recessed lower region 102 for receiving the mounting plate 24 therein. As can be seen in FIG. 8, the mounting plate 24 is received within the recess 102 with the peripheral flange 92 contiguous to the inner peripheral wall of the locker, The peripheral flange is then tack, or spot welded to the inner peripheral wall of the locker (not shown) in a well known conventional manner. Although the lower wall 100 of the locker is illustrated as constituting a unitary construction with the side walls this is not a limitation on this invention. The lower wall can be secured to the peripheral walls of the locker 16A or other storage unit in any desired manner, such as by welding it in place.

To connect the storage unit 16A to the elongate member 30 the storage unit initially is placed on the top wall 32 of the storage unit with the mounting plate 24 in the position shown in FIG. 7A. Specifically the enlarged open segment 94B of each of the teardrop-shaped openings 94 is positioned directly over each of the attachment members 64, 65, 66 and 67. Thereafter, the storage unit is moved rearwardly to slide the unit into a position in which the heads of each of the attachment members 64, 65, 66 and 67 overlie the mounting wall 90 adjacent narrow open segments 94A, as is shown in FIG. 7B. This connects the storage unit 16A to the mounting system 12. It should be noted that each the storage units in the bank of storage units is connected to the mounting system in the same manner. Once the bank of storage units are connected to the mounting system 12, as depicted in FIG. 7B, it is preferred that straps or other securing means are provided to prevent the bank of storage units from being from slid on the mounting system 12 back into the position shown in FIG. 7A, which would disconnect the bank of storage units from the mounting unit. The use of straps or other securing means is well known to those skilled in the art and does not require any further discussion herein.

A representative manner of installing the mounting system 12 on a floor so as to provide a plumb, level surface for supporting a bank of storage units will now be described.

In an illustrative embodiment the mounting system 12 is positioned on a floor 14 in a desired location and leveling screws 74 at the far ends of the top wall 32 are adjusted, either up or down, until the top wall 32 is level front to back and from end to end. Once this is accomplished a concrete anchor, lag screw or other anchor device, e.g., 80, is installed adjacent the four corners of the elongate member 30, but preferably are not fully tightened. This will prevent distortion of the elongate member while at the same time immobilizing the member against undesired movement.

At this point in the operation the assembler can further adjust one or more of the remaining leveling screws so that they all engage the ground 14 with the top wall 32 remaining level and plumb. This engagement of the leveling screws with the ground provides additional stability for the mounting system; particularly because the screws extend through flanges extending inwardly toward each other and underlying the top wall 32.

In the event there are any significant gaps between sections of the mounting system 12 and the ground, they can be filled in with concrete or other sealing material, if desired.

Finally, after actuating the desired number of leveling screws to engage the ground, the anchor members 80 can be fully tightened to rigidly secure the mounting system 12 to the ground. It may be possible to achieve the desired mounting without employing anchoring members extending through all of the anchor passages 62. However, in the preferred embodiment of the invention, as described above, a mounting system 12 in accordance with the preferred embodiment of this invention is designed to receive three or more anchoring members along the elongate extent of the elongate member 30 adjacent each of the sidewalls 18, 20 thereof. In a like manner, the mounting system 12 is designed to receive five (5) leveling adjuster members 70 along the elongated extent of elongate member 30, adjacent each of the sidewalls 18, 20 thereof. This provides a great deal of flexibility in both leveling the elongate member and rigidly attaching that member to a ground surface. Of course, the number of anchoring members and leveling adjuster members employed in the mounting system of this invention will depend, in part, on the length of the mounting system and the number of storage units in the bank of such units that are to be supported on and attached to the mounting system. The number of anchoring members and leveling adjuster members that can be accommodated in the mounting system 12 does not constitute a limitation on the broadest aspects of the invention. However, it is very desirable to provide at least four leveling adjuster members located adjacent the corners of the top wall 32 to provide the desired leveling function; end-to-end and side-to-side.

Figure 9:
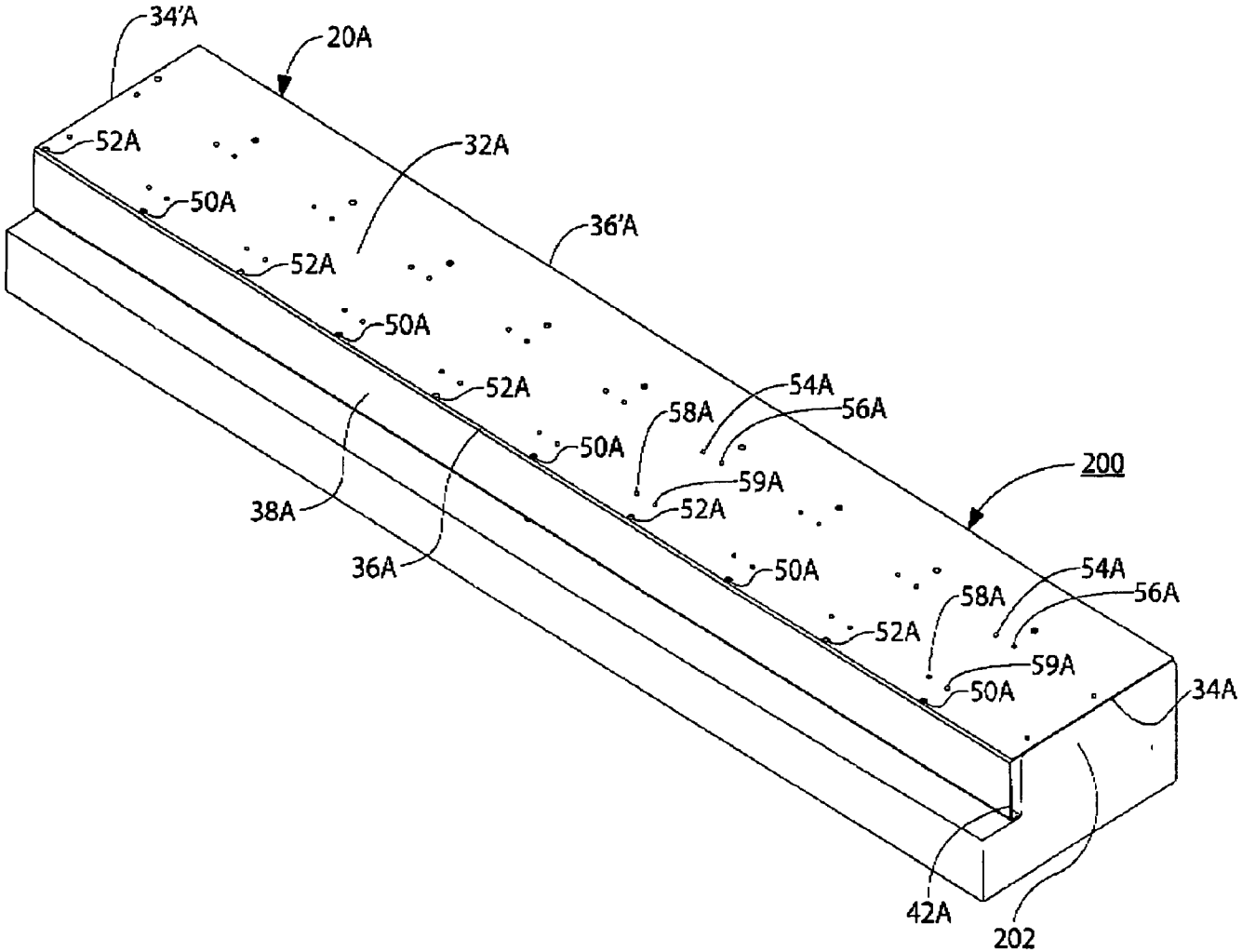
FIG. 9 schematically illustrates an additional embodiment of this invention wherein the mounting system of this invention is employed with a floor structure provided with a raised concrete abutment that in prior art constructions would be employed to receive the storage units thereon.

Referring to FIG. 9, an alternative embodiment of a mounting system is illustrated at 200, and is constructed to be utilized when the ground or floor includes a raised slab 202 extending generally to a vertical wall of the facility in which the lockers are to be attached. Prior to this invention, the bank of lockers were mounted directly on the raised slab 202, which generally did not have a level surface. This necessitated a significant effort in attaching the lockers to the slab in a level, plumb condition.

Still referring to FIG. 9, mounting system 200 includes an elongate member 20A that is identical to the elongate member 30, with the exception that only one of the leg sections 38A is provided and the leveling and anchoring members employed with the elongate member 30 are only employed on one side (i.e., the side including the leg section 38A) of the elongate member 20A. In the description which follows elements of elongate member 20A that are identical to elements of elongate member 30 will be referred to by the same number but with an "A" suffix.

As can be seen in FIG. 9, the elongate member 20A includes a top wall 32A overlaying the raised slab 202 and this top wall includes a plurality of leveling adjuster access passages 50A and a plurality of anchor access passages 52A. These latter access passages are aligned with leveling adjuster passages and anchor passages extending through flange 42A, in the same manner as the leveling adjuster passages 60 and anchor passages 62 are aligned with the leveling adjuster access passages 50 and anchor access passages 52, respectively, in the elongate member 30.

Also, it should be noted that top wall 32A of the elongate member 20A is provided with a plurality of sets of attachment member passages identical to the sets employed in the elongate member 30. The passages in each of the sets are identified in FIG. 9 by the numerals 54A, 56A, 58A and 59A, respectively. These latter passages are designed to receive shoulder rivets or any other suitable member, in the same manner as employed in connection with elongate member 30.

It should be noted that in the FIG. 9 embodiment the leveling of the mounting system 200 only takes place from one end to the other end adjacent only one of the side edges. Thus, if this does not provide adequate leveling of the top wall 32A of the elongate member 20A to properly support a bank of storage units it may be necessary to employ shims between the top wall 32A and the upper surface of the slab 202 along the elongate extent of the top wall 32A, on the side of the elongate member 20A that does not include leg section 38A. However, unlike prior art systems in which a bank of storage units were mounted directly on a concrete slab, in this invention it is not necessary to individually level each of the storage units in the bank. Rather, only the top wall 32A of the elongate member needs to be leveled for receiving the bank of storage units.

Of course, if a floor includes a concrete slab 202 that is spaced from the walls of a facility it is within the scope of the present invention to directly mount the elongate member 30 in a position overlaying the raised slab 202 to thereby provide a level surface for supporting the bank of storage units.

In accordance with the preferred embodiments of this invention the mounting systems provide an ideal mounting surface that is flat and level for supporting a bank of storage units, such as lockers, in a properly aligned arrangement. This permits the proper functioning of doors of the storage unit and latching mechanisms and proper mating of adjacent storage units.

In addition the mounting systems of this invention preferably are made of aluminum or other non-corrosive material and will thereby isolate the storage units from corrosion-causing moisture.

The mounting systems of this invention dramatically simplify the installation of storage units, such as lockers. As noted earlier, in accordance with current practice lockers to be mounted in a bank of lockers need to be individually shimmed to compensate for deficiencies in the concrete surface on which the lockers are mounted. Each locker must be leveled and shimmed individually to achieve proper function and fit of the lockers. This is avoided by employing the mounting systems of this invention.

In addition, in accordance with current practice the storage units need to be positioned and moved on a rough concrete surface to provide the desired alignment. This is difficult to accomplish and also can damage the paint or other finish on the bottom of the storage unit.

The mounting system of this invention makes it possible to level a plurality of storage units in a bank at one time instead of leveling each of the storage units separately.

In accordance with current practice wherein storage units are mounted directly on concrete surfaces, anchors or lag bolts are installed through the bottom shelf of each of the lockers to secure each of the lockers to the concrete. This often distorts or deforms the bottom shelf and also provides an unsightly mounting bolt surface exposed on the upper surface of the bottom shelf. In addition, the exposed bolt surface can limit use of the bottom shelf and also may present a safety hazard. In accordance with this invention, the unique mounting plate provides a blind mounting system for the locker which does not interfere in any way with the continuity of the bottom wall of the locker.

In addition, in accordance with the preferred embodiment of this invention the mounting system provides four (4) consistently spaced anchoring points located to mount the storage units adjacent the outer boundaries thereof. By placing the mounting points close to the outer boundaries of the storage units and by mounting the storage units through a relatively heavy gauge mounting plate that is welded to the frame of the storage unit the rigidity of the assembled system is improved relative to prior art systems in which fasteners generally are spaced closer to the center of the storage units to allow room for the installation tool to fit inside the locker. It should be noted that the mounting plate 24 preferably is of a heavier gauge than the bottom panel or wall of the locker.

The plurality of leveling devices or screws that are adjusted to engage or contact the floor provides additional support and strength in the vertical plane along the elongate extent of the elongate members, thereby increasing the strength of the mounting system, which preferably is formed as a unitary extruded aluminum member. Specifically, the use of leveling screws along the length of the elongate member of the mounting system provides vertical support to the top wall along its entire length and adapts the mating of the mounting system to the floor or other ground surface to thereby compensate for localized dips or sags in the floor or other mounting surface.

In accordance with this invention the actuation of the leveling screws is accomplished through the top surface of the mounting systems and provides for easy access and adjustment of the system. In addition, the mounting system 12 in accordance with this invention provides a mounting surface that fully supports the entire bank of storage units.

In addition, the mounting system of this invention is lightweight and installed with very simple tools. Thus, use of the invention is ideal for installing a bank of storage units in areas where it is difficult to transport concrete and/or the equipment to pour concrete.

In addition, the mounting system of this invention can be installed in a "clean" environment and will not have any impact on the surrounding area or access ways. Pouring concrete, on the other hand, can be very messy and require significant clean-up.

While the invention has been described in detail and with reference to specific embodiments thereof, it will be apparent to one skilled in the art that various changes and modifications can be made therein without departing from the spirit and scope thereof.

What is claimed is:

1. A mounting system for mounting a bank of storage units in side-by-side relationship above a ground surface, each of said storage units in said bank of storage units including a mounting plate for attachment to said mounting system, said mounting system including:

a. an elongate member having a top wall having an elongate dimension between opposed ends and a transverse dimension between opposed elongate side edges, at least one elongate leg section extending downwardly from at least one of said opposed elongate side edges, each of said at least one leg sections including a proximal end contiguous to a respective, elongate side edge of said top wall and a distal end terminating in an elongate flange contiguous to the ground surface, said top wall being adapted to receive a bank of storage units in side-by-side relationship on an upper surface thereof and each of said elongate flanges having an elongate dimension between opposed end edges thereof;

b. said top wall including attachment members for cooperating with the mounting plate of each said storage units for attaching the bank of storage units in side-by-side relationship to the top wall;

c. each of said elongate flanges including a plurality of leveling adjuster passages for receiving leveling adjusters therethrough and a plurality of anchor passages separate from said leveling adjuster passages for receiving anchoring members therethrough, said plurality of leveling adjuster passages and plurality of anchor passages being spaced along the elongate dimension of each said elongate flanges;

d. said plurality of leveling adjuster passages in each of said elongate flanges including leveling adjuster passages located adjacent each elongate end of said flanges for receiving leveling adjusters therethrough for engaging the ground surface to assist in leveling the top wall;

e. said plurality of anchor passages being adapted to receive anchoring members insertable into the ground surface for securing the elongate member to said ground surface;

f. said elongate flanges extend inwardly in underlying relationship with said top wall, said top wall having a plurality leveling adjuster access passages and a plurality of anchor access passages separate from said leveling adjuster access passages, said plurality of leveling adjuster access passages and said plurality of anchor access passages in said top wall being aligned with a plurality of leveling adjuster passages and anchor passages in said underlying flanges, respectively, to thereby permit actuation of leveling adjusters and anchoring members through the top wall of said elongate member.

2. The mounting system of claim 1, including a leg section extending downwardly from each side edge of said elongate member, each leg section including a proximal end contiguous to a respective, elongate side edge of said top wall and a distal end terminating in an elongate flange contiguous to the ground surface, said leveling adjuster passages located adjacent each elongate end of the flanges for receiving leveling adjusters therethrough for engaging the ground surface to assist in leveling the top wall substantially from end-to-end and substantially from side edge-to-side edge to thereby provide the top wall that is substantially level for receiving said bank of storage units.

3. The mounting system of claim 1, wherein said elongate member is a unitary, extruded metal member.

4. The mounting system of claim 1, wherein said elongate member is a unitary, extruded, aluminum member.

5. The mounting member of claim 1, for mounting the bank of lockers in side-by-side relationship above the ground surface.

6. The combination of a mounting system for mounting a bank of storage units in side-by-side relationship above a ground surface and a bank of storage units attached thereto, said storage units include peripheral side walls, a peripheral back wall and a bottom wall, said mounting system including an elongate member having a top wall having an elongate dimension between opposed ends and a transverse dimension between opposed elongate side edges, at least one leg section extending downwardly from at least one of said opposed elongate side edges, each of said at least one leg sections including a proximal end contiguous to a respective, elongate side edge of said top wall and a distal end terminating in an elongate flange contiguous to the ground surface, said elongate flanges including a plurality of leveling adjuster passages and a plurality of anchor passages therethrough; leveling adjusters extending through the leveling adjuster passages and engaging the ground surface to assist in leveling the top wall; a plurality of anchoring members extending through the anchor passages and into the ground surface for securing the elongate member to said ground surface; each of said storage units including a mounting plate and said top wall of the mounting system including attachment members connected to the mounting plate for attaching each of the storage units in the bank of storage units to the top wall of the mounting system, said mounting plate of each storage unit being a plate secured to one or more walls of said storage unit below the bottom wall, said plate including a mounting wall with peripheral edges providing openings therein, said peripheral edges of each opening providing a narrow opening segment and an enlarged opening segment; said attachment members including shoulders spaced upwardly from an upper surface of the top wall and extending through openings in the mounting walls of each storage unit and, in a connected position, overlaying surfaces of the mounting wall adjacent narrow segments of the openings.

7. The combination of claim 6, said top wall including a pair of leg sections extending downwardly from opposed side edges of said top wall and a flange extending from a lower end of each leg section.

8. The combination of claim 7, wherein said storage units are lockers.

9. The combination of claim 7, wherein said elongate member is a unitary, extruded metal member.

10. The combination of claim 7, wherein said elongate member is a unitary, extruded, aluminum member.

11. The combination of claim 7, for mounting a bank of lockers in side-by-side relationship above a ground surface.

12. The combination of claim 6, wherein the storage units are lockers.

13. The combination of a mounting system for mounting a bank of storage units in side-by-side relationship above a ground surface and a bank of storage units attached thereto, said mounting system including an elongate member having a top wall having an elongate dimension between opposed ends and a transverse dimension between opposed elongate side edges, at least one leg section extending downwardly from at least one of said opposed elongate side edges, each of said at least one leg sections including a proximal end contiguous to a respective, elongate side edge of said top wall and a distal end terminating in an elongate flange contiguous to the ground surface, said elongate flanges extending in underlying relationship to said top wall and including a plurality of leveling adjuster passages and a plurality of anchor passages therethrough; leveling adjusters extending through the leveling adjuster passages and engaging the ground surface to assist in leveling the top wall; a plurality of anchoring members extending through the anchor passages and into the ground surface for securing the elongate member to said ground surface; said top wall having a plurality leveling adjuster access passages and a plurality of anchor access passages aligned with the plurality of leveling adjuster passages and the plurality of anchor passages in said underlying flanges, respectively, said leveling adjusters and said anchoring members being actuated through the leveling adjuster access passages and the anchor access passages in said top wall, respectively, for assisting in leveling the top wall of the mounting system and for securing the mounting system to the ground surface each of said storage units including a mounting plate and said top wall of the mounting system including attachment members connected to the mounting plate for attaching each of the storage units in the bank of storage units to the top wall of the mounting system.

* * * * *